United States Patent [19]

Lemkin

[11] 4,018,338

[45] Apr. 19, 1977

[54] BOX AND LID THEREFOR

[75] Inventor: Jack L. Lemkin, Cincinnati, Ohio

[73] Assignee: Midland-Ross Corporation, Cleveland, Ohio

[22] Filed: Nov. 3, 1975

[21] Appl. No.: 628,391

[52] U.S. Cl. ..... 206/505; 206/508; 220/380; 229/43

[51] Int. Cl.[2] ..... B65D 21/04; B65D 21/02; B65D 55/00; B65D 43/00

[58] Field of Search ..... 206/508, 505, 511, 509; 220/23.83, 315, 323, 324, 380; 229/43

[56] References Cited

UNITED STATES PATENTS

| | | | |
|---|---|---|---|
| 2,986,300 | 5/1961 | Parrish | 206/508 X |
| 3,064,876 | 11/1962 | Warner | 229/43 |
| 3,338,468 | 8/1967 | Wilson | 220/380 X |
| 3,383,009 | 5/1968 | Weikert | 206/508 X |
| 3,419,184 | 12/1968 | Asenbauer | 220/324 X |

*Primary Examiner*—William Price
*Assistant Examiner*—Steven M. Pollard
*Attorney, Agent, or Firm*—H. Duane Switzer

[57] ABSTRACT

A molded box and lid have peripheral walls with opposite draft. The lid has hinge means for inward bending movement of at least portions of the lid sidewalls into hugging relationship with the outer upper surfaces of the box peripheral wall to compensate for the gap created by opposing draft angles.

5 Claims, 11 Drawing Figures

BOX AND LID THEREFOR

BACKGROUND OF THE INVENTION

This application pertains to the art of packaging and, more particularly, to packages of the type including a molded box having a molded lid. The box and lid of the present application are particularly applicable for use in packaging relatively flat compressible material such as textile material, and will be particularly described with reference thereto. However, it will be appreciated that the invention has broader aspects and may be used for packaging other materials.

Textile materials and articles of clothing are commonly stacked in a generally rectangular corrugated box to a height well above the top peripheral edge of the box. A lid is then positioned on the stack of textile material and forced downwardly to compress the textile material while wrapping bands are placed around the lid and box. In many instances, a gap remains between the lid and the top peripheral edge of the box so that some of the textile material can be damaged or soiled, and can be removed from the package through the gap. This problem is accentuated in a molded plastic box and lid because of the opposing draft and has heretofore defeated the use of molded boxes in this application.

SUMMARY OF THE INVENTION

A box and lid defining a package particularly applicable for packaging textile materials or the like includes a generally rectangular box in which the textile material is stacked to a height well above the box top peripheral edge. A lid is positioned over the stack of textile material and a force is applied thereto for compressing the textile material while wrapping bands are placed around the box and lid.

The lid is generally rectangular and has outer lid edges to which flaps are hingedly connected by molded-in hinges. The flaps are positionable inwardly at acute angles to the vertical so that the outer flap edges lie on the periphery of a rectangle having an area smaller than the lid. This allows the flaps to closely hug the outer periphery of a box peripheral wall which is inclined outwardly from a box bottom wall to substantially eliminate any gap between the box and the lid.

In a preferred arrangement, the flaps have outer corners spaced inwardly from the corners of the lid so that the outer flap edges have a length slightly less than the length of the lid edges to which they are hingedly connected. This allows the flaps to be inclinded inwardly without having their opposite side edges interfere with one another.

The box is generally rectangular, and has a bottom wall with a peripheral wall extending upwardly and outwardly therefrom to terminate at a top peripheral edge. The box includes a bottom peripheral edge, and the bottom wall is spaced upwardly from the bottom peripheral edge to define a downwardly facing recess in the bottom of the box. The lid has stacking lugs extending upwardly therefrom to fit in the recess of an upper box stacked upon a lower box for preventing sliding movement of the boxes relative to one another.

The lid and box have wrapping band recesses for receiving wrapping bands to prevent sliding movement of such bands relative to the box and lid.

In a preferred arrangement, the box and lid are molded of synthetic plastic material, and the flaps are integral with the lid. In such an arrangement, the flaps normally extend outwardly from the lid so that the outer flap edges lie on the periphery of a rectangle having an area greater than the area of the lid. This insures reception of the flaps over the top peripheral edge of the box so that the flaps do not interfere with compressing of the stacked textile material.

The box and lid are each configured so that a plurality of boxes can be nested within one another and a plurality of lids can be nested within one another.

DESCRIPTION OF A PREFERRED EMBODIMENT

Figure 1:
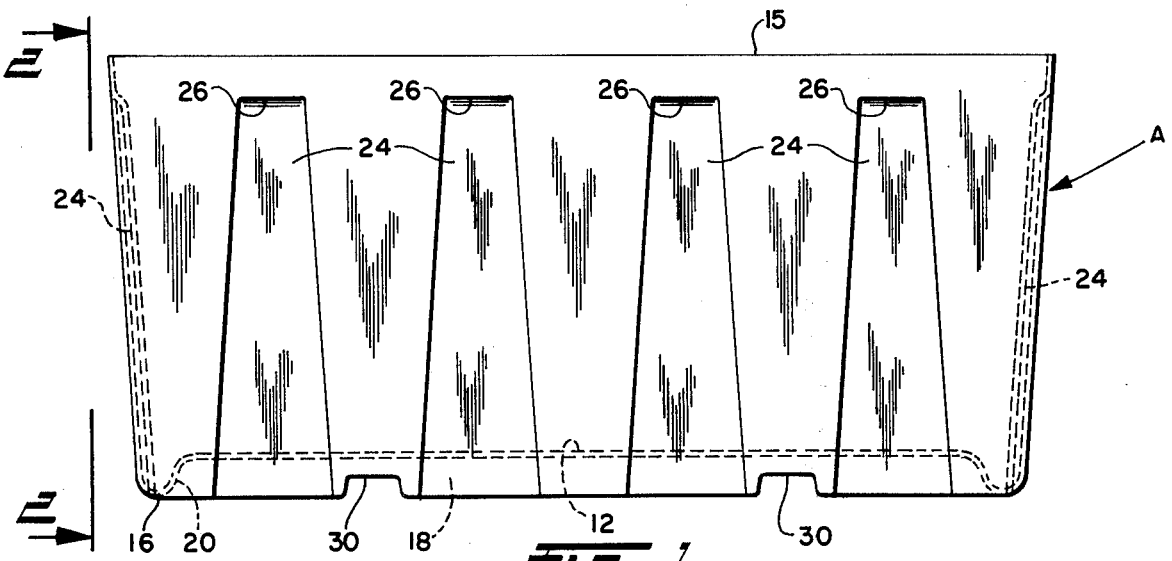
FIG. 1 is a side elevational view of a box constructed in accordance with the present invention.
Figure 2:
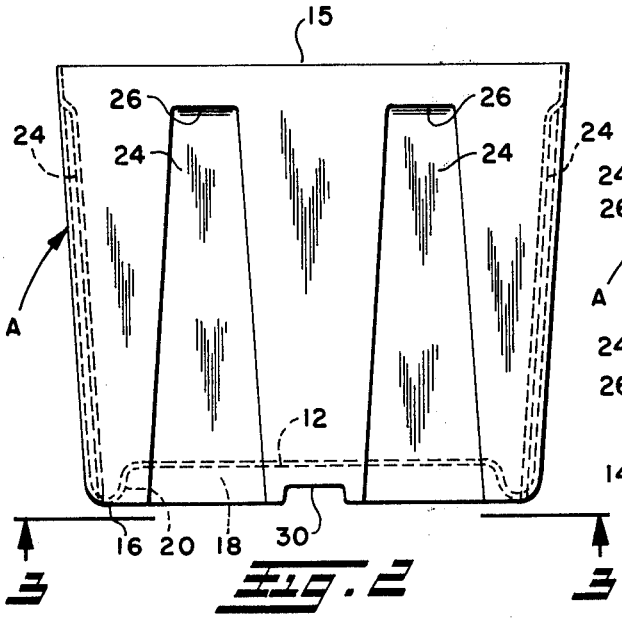
FIG. 2 is an end elevational view looking generally in the direction of arrows 2—2 of FIG. 1.
Figure 3:
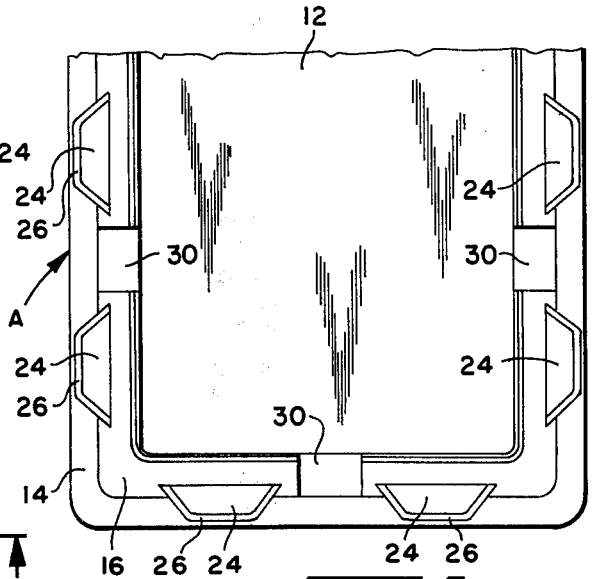
FIG. 3 is a partial bottom view looking generally in the direction of arrows 3—3 of FIG. 2.

Referring now to the drawings, wherein the showings are for purposes of illustrating a preferred embodiment of the invention only and not for purposes of limiting same, FIG. 1 shows a generally rectangular box A which includes a generally rectangular bottom wall 12 having a peripheral wall 14 extending upwardly and outwardly therefrom, and terminating at a top peripheral edge 15. In one arrangement, the box peripheral wall 14 is inclined outwardly at an angle to the vertical of approximately four degrees. Box A is shaped so that a plurality of such boxes can be nested within one another for shipment and storage.

Box A has a bottom peripheral edge generally indicated at 16, and bottom wall 12 is spaced upwardly from bottom peripheral edge 16 to define a downwardly facing generally rectangular recess 18 in the bottom of box A. Bottom wall 12 is integrally connected with bottom peripheral edge 16 and peripheral wall 14 by a smoothly curved connecting portion 20. A plurality of spaced-apart vertically extending stiffening ribs or corrugations 24 are formed in box peripheral wall 14, and extend from bottom peripheral edge 16 to upper edges 26 which terminate short of box top peripheral edge 15.

Wrapping band receiving recesses or notches 30 are formed in box A and extend across bottom peripheral edge 16 thereof. Recesses 30 have a depth less than the depth of bottom recess 18, and are formed along both the sidewalls and end walls of box A.

Figure 4:
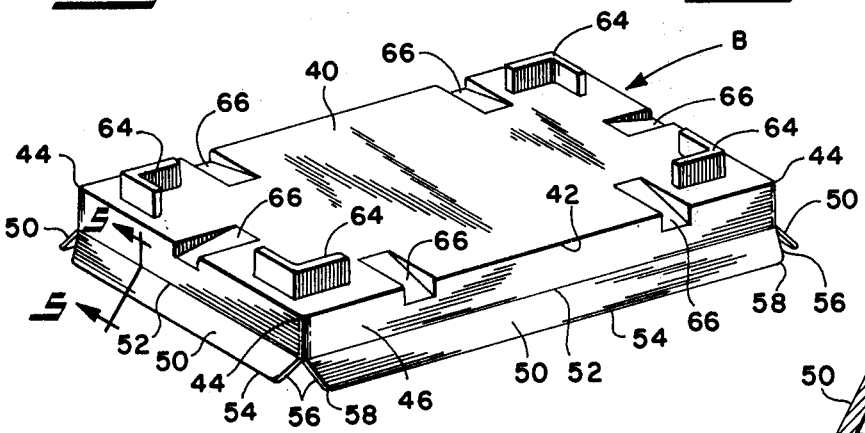
FIG. 4 is a perspective illustration of a lid constructed in accordance with the present invention.

FIG. 4 shows a generally rectangular lid B having a top wall 40 and an outer lid peripheral edge 42. Lid peripheral edge 42 is defined by a plurality of individual lid edges which intersect one another at lid corners 44. Lid B includes a lid peripheral wall 46 extending downwardly therefrom, and is preferably inclined outwardly a few degress to provide draft and to allow a plurality of lids B to be nested within one another.

Flaps 50 are connected with lid peripheral wall 46 as by molded-in hinges 52. In effect, flaps 50 are hingedly connected to the edges of lid B which form peripheral edge 42. In the arrangement shown, lid B and box A are both molded of synthetic plastic material such as polyethylene, although it will be appreciated that other materials can be used. Hinge 52 is simply a reduced thickness portion between peripheral wall 46 and flaps 50. It will be recognized that instead of having an integral molded-in hinge, flaps 50 could be suitably connected with peripheral wall 46 by bonding, or by use of mechanical fasteners.

Figure 5:
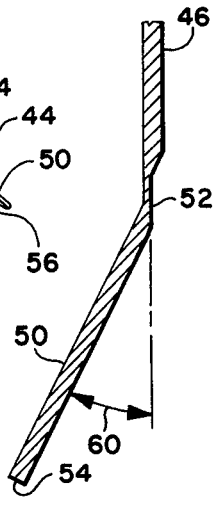
FIG. 5 is a cross-sectional elevational view looking generally in the direction of arrows 5—5 of FIG. 4.
Figure 6:
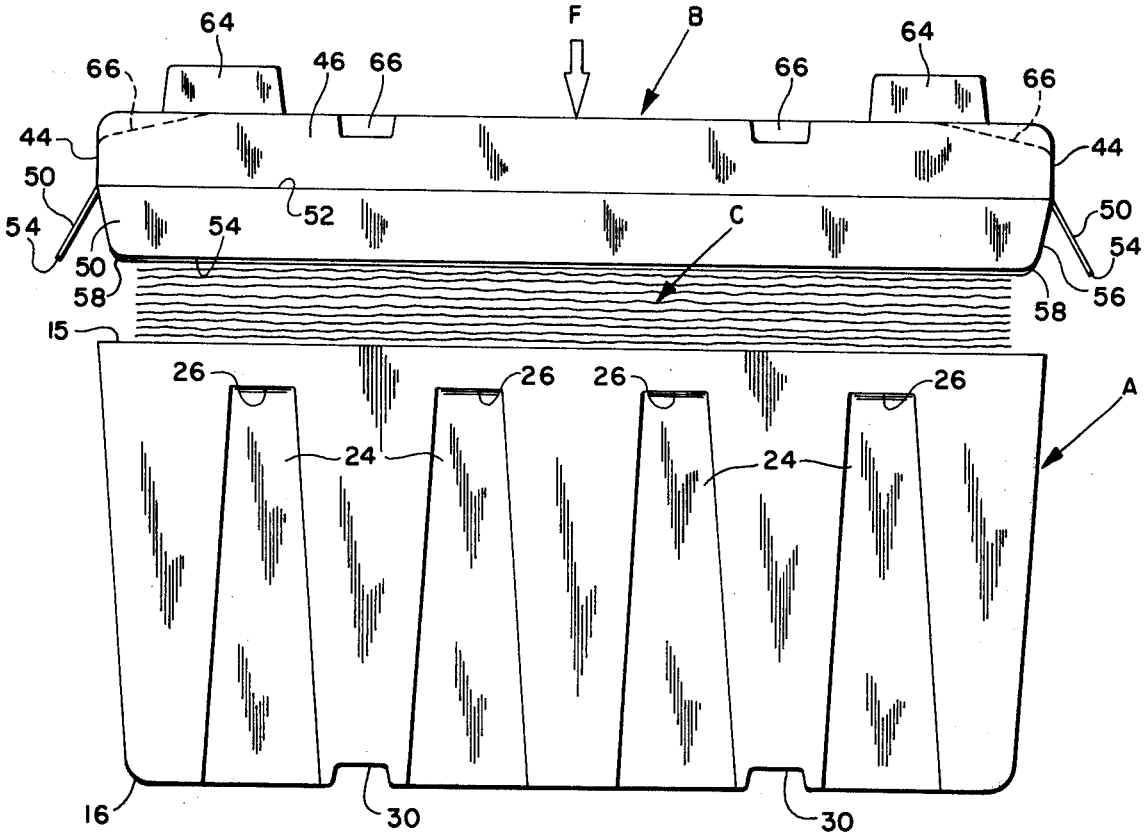
FIG. 6 is a side elevational view showing a box full of textile material and a lid positioned on the textile material.

Flaps 50 have flap edges 54, and opposite flap side edges 56. Flap outer edges 54 intersect flap side edges 56 at flap corners 58. As shown in FIG. 6, flaps 50 have a shape which is generally that of an inverted regular trapezoid. Flaps 50 are preferably hingedly connected with lid B in such a manner that the hinges normally bias flaps 50 outwardly to form an acute angle with the vertical as shown at 60 in FIG. 5. Angle 60 is preferably around 20°–30°, and in the arrangement shown is approximately 30°. Thus, in the normal as-molded free position of flaps 50, they extend outwardly at an acute angle to the vertical so that the outer flap edges 54 lie on the periphery of a rectangle having an area which is greater than the area of lid B within peripheral edge 42 thereof. This allows lid B to be freely positioned over the top of box A without having any interference by flaps 50. Flap corners 58 are spaced inwardly slightly from lid corners 44 so that each outer flap edge 54 is slightly shorter in length than the lid edge to which it is connected. In the arrangement shown, flap side edges 56 are inclined inwardly from lid corners 44. This allows flaps 50 to be hingedly bent inwardly to a position at an acute angle to the vertical with outer flap edges 54 lying on the periphery of a rectangle having an area which is smaller than the area of lid B within peripheral edge 42. The flaps 50 are preferably hingedly movable inwardly at an acute angle to the vertical of around 2°–10°. The slope or stepping of the flap side edges allows the flaps to be positioned inwardly without any interference between side edges of adjacent flaps. In their inwardly bent positions, flaps 50 will closely hug the outwardly inclined peripheral wall 14 on box A once wrapping bands are placed around the lid and box.

Lid B also has integral stacking lugs 64 extending upwardly therefrom adjacent lid corners 44 and spaced inwardly therefrom. The outer surfaces of stacking lugs 64 preferably lie on the periphery of a rectangle which is generally the same as, or slightly smaller than, rectangular recess 18 in the bottom of box A. When a plurality of packages defined by the combined box and lid are stacked upon one another, stacking lugs 64 on a lower package are received within recess 18 on an upper package to prevent sliding movement of the packages relative to one another.

Lid B also includes a plurality of wrapping band receiving recesses 66 which extend across peripheral edge 42 between top wall 40 and peripheral wall 46 thereof. Wrapping band receiving recesses 66 are aligned with recesses 30 in box A when lid B is placed upon box A.

FIG. 6 shows a box A filled with a stack of textile material C such as fabric or clothes. Textile material C is stacked within box A to a height substantially greater than top peripheral edge 15 of box A. A force generally indicated by F in FIG. 6 is then applied to lid B for compressing textile material C and moving lid B downwardly over top peripheral edge 15 of box A. With the force still applied to lid B, wrapping bands 70 are secured in position to hold lid B on box A. Wrapping bands 70 are positioned in recesses 30 and 66 so they cannot be slid relative to box A or lid B. Wrapping bands 70 hingedly bend flaps 50 inwardly to hug the upper outer surface of box peripheral wall 14. This arrangement leaves no gaps between box A and lid B so that soiling or damage to textile material C is minimized, as is pilferage.

In arrangements wherein the bottom wall of the box is generally flush with the box bottom peripheral edge, compression of the textile material tends to make the box bottom wall bow outwardly so that it will not rest firmly on a level supporting surface, and is difficult to stack on top of another box. In the present arrangement, with box bottom wall 12 recessed upwardly from box bottom peripheral edge 16, outward bowing of bottom wall 12 is accommodated by recess 18 so that box A will rest firmly on bottom peripheral edge 16. The outward bowing of bottom wall 12 into recess 18 does not interfere with reception of stacking lugs 64 on a lower package because stacking lugs 64 are receivable generally in the corners of recess 18 where little bowing occurs.

Flaps 50 have a length from hinges 52 to outer edges 54 thereof which is substantially less than the length and width of lid top wall 40. In one arrangement, that length of flaps 50 is generally the same as the height of lid peripheral wall 46. In many instances, lid B will be secured to a box A with hinge lines 52 still spaced slightly upwardly of top peripheral edge 15 of box A. However, hinged flaps 50 will extend downwardly below top peripheral edge 15 of box A and tightly hug outer peripheral wall 14 thereof so that substantially no gap remains between the lid and box when they are strapped together with wrapping bands or the like.

Figure 7:
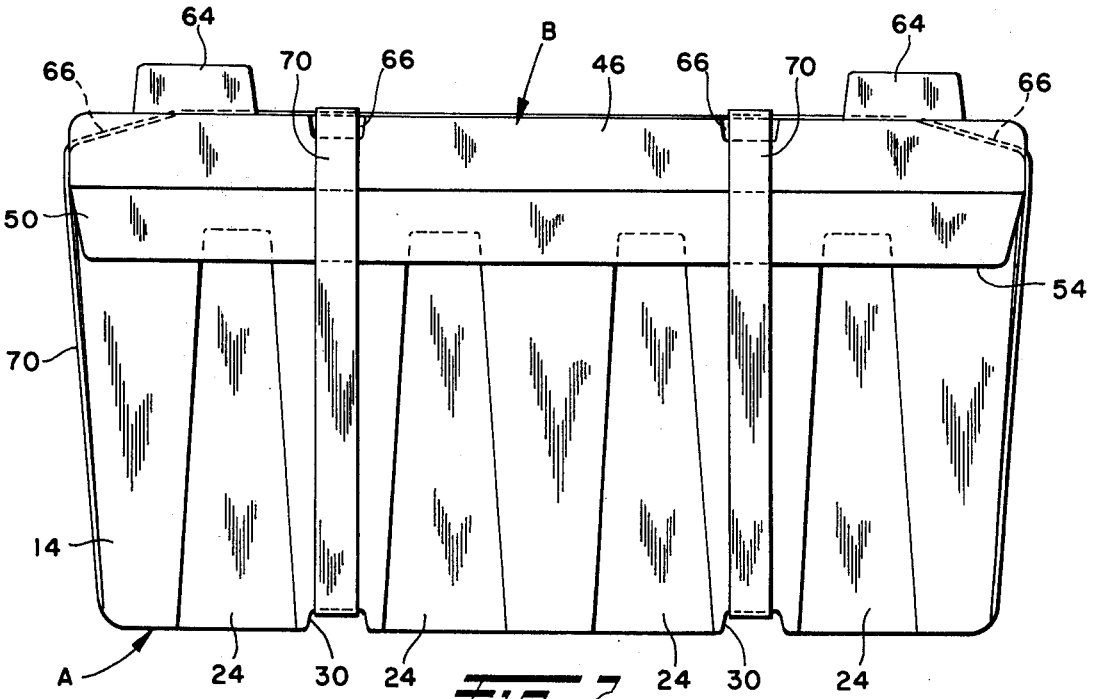
FIG. 7 is a side elevational view showing a box and lid package after the lid has been secured to the box by wrapping bands.
Figure 8:
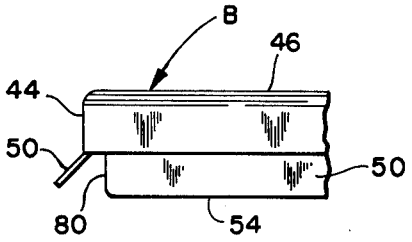
FIG. 8 is a partial side elevational view of another box lid.

Instead of having opposite flap side edges 56 inclined inwardly toward outer edge 54 thereof as best shown in FIGS. 6 and 7, the opposite side edge portions of the flaps can be stepped inwardly in the manner of a generally rectangular recess or notch as shown at 80 in FIG. 8. Obviously, many other arrangements can be provided for allowing the flaps to be bent inwardly for closely hugging the outer upper surface of the box peripheral wall without having the flap side edges interfere with one another.

Figure 9:
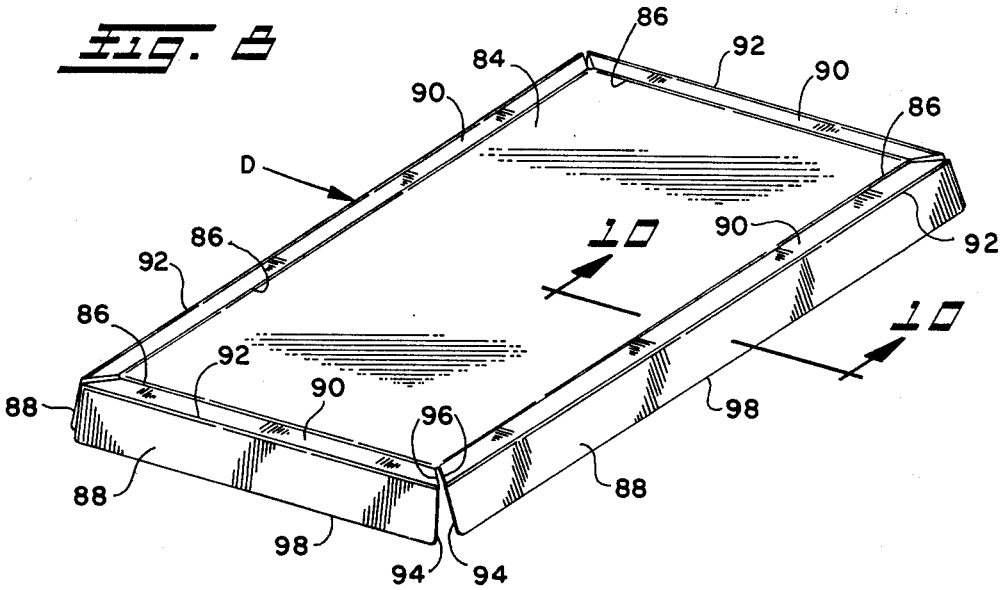
FIG. 9 is a perspective illustration of a modified lid.
Figure 10:
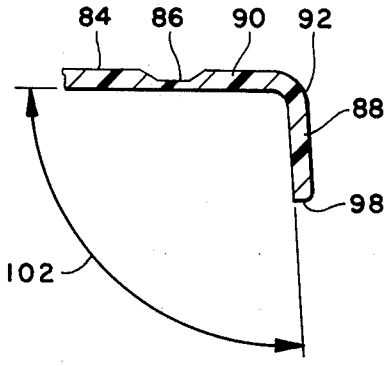
FIG. 10 is a partial cross-sectional elevational view taken generally on line 10—10 of FIG. 9.
Figure 11:
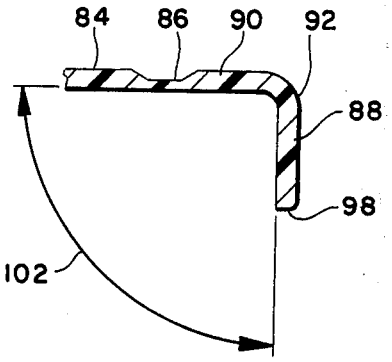
FIG. 11 is a view similar to FIG. 10 showing the lid sidewall after the lid and a box have been strapped together.

FIGS. 9–11 show a modified generally rectangular lid D of synthetic plastic material having a generally rectangular flat top wall panel 84 into which hinges 86 are integrally molded. A peripheral wall on lid D is defined by downwardly extending sidewalls 88 intersecting generally horizontal portions 90 at corners 92. The corners of lid D are cut-away so that adjacent side edges 94 of sidewalls 88 and adjacent side edges 96 of portions 90 are spaced-apart at the lid corners. This allows portions 90 and sidewalls 92 to be bent inwardly about hinges 86 without interference between adjacent sidewall side edges 94 and side edges 96 of portions 90. Sidewall outer edges 98 have a length less than the length of corners 92 between each sidewall 88 and its portion 90.

In the as-molded condition of lid D, portions 90 extend upwardly out of the plane of flap panel 84 a few degrees about hinges 86 so that sidewalls 88 are inclined outwardly from the vertical at angles of a few degrees. In other words, the included angle 102 between flat panel 84 and each sidewall 88 is several degrees greater than 90°. When lid D is strapped to the top of a box A in the manner described with respect to the embodiment of FIGS. 6 and 7, the included angle 102 between flat panel 84 and each sidewall 88 will be several degress less than 90°, and portions 90 will be inclined downwardly about hinges 86 relative to panel 84. After strapping lid D on a box, outer edges 98 of sidewalls 88 will closely hug the outer upper surface of the box peripheral wall.

Lid D has been shown relatively plain for simplicity of illustration. However, it will be recognized that lid D would also be made with stacking lugs 64 and wrapping band recesses 66 on lid B of FIG. 4. The wrapping band recesses would only extend across corners 92 between portions 90 and sidewalls 88, and not across hinges 86.

Lid D may be considered as having lid edges where hinges 86 connect with panel 84 so that portions 90 would be considered part of the hinged flaps or sidewalls. In the alternative, lid D may be considered to have edges corresponding with corners 92 so that parts of the lid itself defined by portions 90 are hinged with sidewalls 88.

In the embodiment of FIGS. 1–7, flaps 50 are actually an integral part of the sidewall or peripheral wall 46 of the lid. In both embodiments, at least portions of the lid sidewalls are hingedly bendable inwardly for closely hugging the outer surface of the box peripheral wall when the lid and box are strapped together. This close hugging relationship prevents even driving rain or sleet from damaging the contents of the box and allows the packages defined by strapped together lids and boxes to be stacked very close together.

The box has an upwardly extending outwardly inclined peripheral wall, while the lid has a downwardly extending outwardly inclined peripheral wall. The opposite draft on the box and lid peripheral walls would normally leave a substantial gap between the bottom edge of the lid peripheral wall and the outer upper surface of the box peripheral wall. However, with the improved construction of the present invention, the gap is substantially eliminated by having at least portions of the lid peripheral wall hingedly bendable inwardly into close hugging relationship with the outer upper surface of the box peripheral wall when the box and lid are strapped together.

Portions 90 and sidewalls 88 taken together may be considered flaps having outer flap edges 98 and being hingedly connected with lid D. In either lid B or D, the flaps are normally positioned in normal positions inclined outwardly at small angles to the vertical with outer flap edges 54 or 98 lying on the periphery of rectangle larger than a reference rectangle on which such edges would lie if the flaps were positioned vertically. The flaps are hingedly movable inwardly to inward positions inclined at small angles to the vertical and with flap edges 54 or 98 lying on the periphery of a rectangle smaller than the reference rectangle. The opposite side edges of the flaps are inwardly inclined or recessed so that such side edges on adjacent flaps do not interfere with one another during movement of the flaps to their inward positions.

In the embodiment of FIG. 4, hinges 52 are located below generally flat top wall 40, while in the embodiment of FIG. 9 hinges 86 are located generally in the plane of top wall 84.

Although the present invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A package comprising; a molded box and lid of substantially rigid synthetic plastic material, said box and lid having opposing draft angles, said molded box being nestable with like boxes and including an upwardly extending outwardly inclined box peripheral wall having an upper box peripheral edge substantially coplanar with said box peripheral wall, said molded lid being nestable with like lids and having a downwardly and outwardly extending lid peripheral wall, said lid being positionable on said box with said lid peripheral wall overlapping said upper box peripheral edge outwardly thereof so that the inner surface of said lid peripheral wall and the outer upper surface of said box peripheral wall adjacent said upper box peripheral edge directly face one another in nonparallel relationship at opposed draft angles to define a gap therebetween which increases in width in a direction from said upper box peripheral edge toward the bottom of said box, at least portions of said lid peripheral wall being hinged to define flaps for inward bending movement into close hugging relationship with only the outer upper surface of said box peripheral wall to substantially close said gap when said lid and box are strapped together, said flaps being hinged along molded hinges defined by reduced thickness portions of said lid, said flaps having outer edges of a length slightly less than the length of said flaps along said hinges, and said hinges being molded to normally bias said flaps outwardly of said lid at small angles to the vertical.

2. The package of claim 1 wherein said lid includes a lid top wall intersecting said lid peripheral wall at intersecting edges, and wrapping band receiving recesses extending only across said edges and short portions of said lid top wall and lid peripheral wall and not across the entire said lid top wall or lid peripheral wall.

3. The package of claim 1 wherein said box has a bottom periphery and a bottom spaced above said bottom periphery to define a downwardly facing bottom recess in said box, said lid having a plurality of stacking lugs extending upwardly therefrom for reception in the bottom recess of an upper package stacked thereon.

4. The package of claim 1 wherein said lid has a generally flat top wall and said portions of said lid peripheral wall which are hinged for inward bending movement are hinged about hinge lines spaced below said top wall.

5. The package of claim 1 wherein said lid has a generally flat top wall and said portions of said lid peripheral wall which are hinged for inward bending movement are hinged about hinge lines located generally in the plane of said top wall.

* * * * *